US010583650B2

(12) United States Patent
Sender Beleta et al.

(10) Patent No.: US 10,583,650 B2
(45) Date of Patent: Mar. 10, 2020

(54) ADJUSTING A DRIVE SIGNAL TO COMPENSATE FOR A DIFFERENCE BETWEEN PATTERN PORTIONS

(71) Applicant: Hewlett-Packard Development Company, L.P., Houston, TX (US)

(72) Inventors: Jordi Sender Beleta, Barcelona (ES); Montserrat Solano Pallarol, Sant Cugat del Valles (ES); Alejandra Terron Arregui, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 388 days.

(21) Appl. No.: 15/069,119

(22) Filed: Mar. 14, 2016

(65) Prior Publication Data

US 2016/0214376 A1 Jul. 28, 2016

Related U.S. Application Data

(63) Continuation of application No. 14/762,794, filed as application No. PCT/EP2013/051557 on Jan. 28, 2013, now Pat. No. 9,296,238.

(51) Int. Cl.

| | |
|---|---|
| ***B41J 29/393*** | (2006.01) |
| ***B41J 2/045*** | (2006.01) |
| ***B41J 2/21*** | (2006.01) |

(52) U.S. Cl.

CPC ..... *B41J 2/04505* (2013.01); *B41J 2/04586* (2013.01); *B41J 2/2142* (2013.01);

(Continued)

(58) Field of Classification Search

CPC .. B41J 2/04505; B41J 2/04586; B41J 2/2146; B41J 2/2142; B41J 29/393; B41J 2029/3935; B41J 2/512

(Continued)

(56) References Cited

U.S. PATENT DOCUMENTS

| | | | |
|---|---|---|---|
| 6,076,915 | A | 6/2000 | Gast et al. |
| 6,940,618 | B2 | 9/2005 | Kinas |

(Continued)

FOREIGN PATENT DOCUMENTS

| | | | |
|---|---|---|---|
| CN | 102470676 | 5/2012 | |
| EP | 1764996 | 3/2007 | |
| EP | 1764996 A1 * | 3/2007 | ..... B41J 2/2135 |

OTHER PUBLICATIONS

Deng, Tao, et al. "Prototyping of masks, masters, and stamps/molds for soft lithography using an office printer and photographic reduction." Analytical chemistry 72.14 (2000): 3176-3180.

(Continued)

*Primary Examiner* — Huan H Tran
*Assistant Examiner* — Michael Konczal
(74) *Attorney, Agent, or Firm* — Trop Pruner & Hu PC

(57) ABSTRACT

In some examples, a printer determines a difference between an enlarged calibration pattern portion printed on a substrate by a first portion of a nozzle array of the printer and an enlarged reference pattern portion printed on the substrate by a second portion of the nozzle array, the enlarged calibration pattern portion produced by printing respective smaller calibration pattern portions at corresponding different relative positions between the nozzle array and the substrate, and the enlarged reference pattern portion produced by printing respective smaller reference pattern portions at corresponding different relative positions between the nozzle array and the substrate. The printer adjusts at least one drive signal to at least one of the first portion of the nozzle array and the second portion of the nozzle array to compensate for the determined difference.

19 Claims, 9 Drawing Sheets

(52) U.S. Cl.
CPC ..... *B41J 2/2146* (2013.01); *B41J 29/393* (2013.01); *B41J 2029/3935* (2013.01)

(58) Field of Classification Search
USPC ..... 347/19
See application file for complete search history.

(56) References Cited

U.S. PATENT DOCUMENTS 7,014,289 B1 3/2006 Matsuda
7,445,313 B2 11/2008 Tsutsumi
8,427,698 B2 4/2013 Swanson et al.
8,496,315 B2 * 7/2013 Maruo ..... H04N 1/50 347/13
8,894,177 B2 * 11/2014 Yoshikawa ..... B41J 2/2142 347/19
9,056,463 B2 * 6/2015 Sasayama ..... B41J 2/125
2006/0119633 A1 6/2006 Hsu et al.
2006/0274106 A1 12/2006 Park
2009/0009812 A1 1/2009 Sirringhaus et al.
2010/0207983 A1 * 8/2010 Sasayama ..... B41J 29/393 347/14
2010/0220365 A1 * 9/2010 Sasayama ..... B41J 2/2146 358/448
2011/0074862 A1 * 3/2011 Sasayama ..... B41J 2/2139 347/19
2011/0279504 A1 11/2011 Mizes
2012/0114188 A1 5/2012 Takeshi et al.
2017/0361635 A1 * 12/2017 Quintero Ruiz ..... B41J 2/04505

OTHER PUBLICATIONS

European Patent Office, International Search Report for PCT Patent Application No. PCT/EP2013/051557 dated Oct. 1, 2013 (4 pages).

* cited by examiner

NG (1st portion of nozzle array)
printbar
POS1
A

POS2

AFTER S10
CP

FCP
CP
AFTER S12, 1st example
Enlargement of calibration pattern portions

FCP'
AFTER S12, 2nd example
CP'

ADJUSTING A DRIVE SIGNAL TO COMPENSATE FOR A DIFFERENCE BETWEEN PATTERN PORTIONS

CROSS REFERENCE TO RELATED APPLICATIONS

This is a continuation of U.S. application Ser. No. 14/762,794, filed Jul. 22, 2015, U.S. Pat. No. 9,296,238, which is a national stage application under 35 U.S.C. § 371 of PCT/EP2013/051557, filed Jan. 28, 2013, which are both hereby incorporated by reference in their entirety.

BACKGROUND

When images are printed by printing devices, various defects and irregularities can appear in the printed image, for example dot placement error, lack of fidelity in reproduction of colours, and so on. There are also various causes of printing defects, for example ink-drop weight variability, misalignment of printheads, and so on. In multi-pass printing the location where an irregularity occurs on each pass may become randomized, so that irregularities are reduced or, at least, they are less visible in the final printed image. In one-pass printing this randomizing of the positions of irregularities does not occur.

Some printing devices include components designed to detect and compensate for printing irregularities, for example by printing a calibration pattern, by automatically detecting and analysing the printed calibration pattern and then performing some compensation operation based on the result of the analysis. In some cases the component used for detecting the printed calibration pattern has a limited resolution and, in particular, cannot accurately detect irregularities that are smaller than a certain size. For example, this may be the case for the densitometers used in some printing devices. However, the human eye may still be able to detect these small irregularities.

In some cases it may be assumed that users who employ a one-pass printing mode will be prepared to tolerate a reduced quality printed image, so no extra measures will be taken. The underlying assumption would be that the user can employ a multi-pass print mode if a higher quality printed image is desired. However, an alternative approach would be to improve the detection component that is used in the printing device to detect the calibration pattern. This could be done, for example, by adding a further sensor or scanning element, or by using a higher-performance detection element. Of course, use of an additional component or use of a higher-performance detector would be expected to increase the cost of the printing device.

Another alternative approach would be to make a detailed measurement of the printing irregularities produced by a printing device at the stage where the device is being manufactured, and to build into the printing device a pre-calculated correction or compensation. However, the use of a predetermined correction may not be adequate to compensate for the printing irregularity in the case where the printing error varies in a dynamic manner, for example based on environmental factors, printing speed, and so on.

Page wide array printing devices (PWA printing devices) have come into use and can print simultaneously over the whole width of a substrate. It is common for PWA printing devices to implement one-pass printing. When a PWA printing device uses a scanning element (e.g. a densitometer) that is not capable of accurately detecting small irregularities produced during one-pass printing but which are still visible to the human eye, the user may consider that the quality of the printed image to be inadequate.

BRIEF DESCRIPTION OF THE DRAWINGS

Calibration-pattern printing methods, calibration methods and page wide array printers according to some examples of the invention will now be described, by way of illustration only, with reference to the accompanying drawings.

DETAILED DESCRIPTION

In this text, unless the context demands otherwise the expression printing device or printer will be used generically for devices which can produce printed output, irrespective of whether the device is a printer, a photocopier, a facsimile machine, an all-in-one apparatus, etc.

Figure 1:
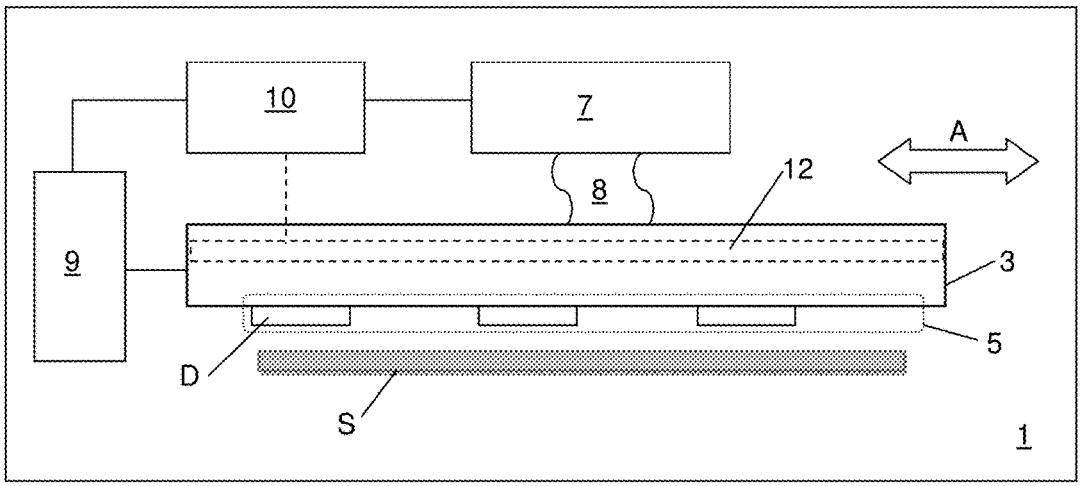
FIG. 1 schematically shows an example of an inkjet printing device.

FIG. 1 schematically shows an inkjet printing device 1 which is an example of a printing device in which the present invention may be implemented. In this example the printing device 1 is a page wide array printer and it has a printbar 3 with an array 5 of print nozzles extending in the widthwise direction of the printer so as to be able to print simultaneously over the full width of a page of a substrate or medium S. The substrate S may take any convenient form including but not limited to paper, cardboard, plastics or textiles material, in sheet form, in web form, and so on.

In this example the print nozzles are provided on several print dies D and in this example the print dies are arranged on the printbar in two staggered rows. In FIG. 1 only one row of print dies is represented and only three dies are shown but it should be mentioned that any convenient number of print dies may be used.

Ink is supplied to the print nozzles from a reservoir (not shown) and is dispensed by any convenient mechanism (for example, using heating, using piezoelectric effects, and so on) when the nozzles are activated. The print nozzles of the array 5 are activated under the control of a print controller 7 which is connected to the print nozzles by a connector 8 which may take any convenient form, for example a flexible printed circuit board.

Unlike many page wide array printers, the printer of FIG. 1 has a printbar 3 that is designed so that the nozzle array 5 can be moved in the widthwise direction of the printer, as illustrated by the arrow A in FIG. 1. A printbar-position controller 9 controls the position of the printbar in the widthwise direction of the printer. Any convenient positioning mechanism may be used to position the printbar in a desired position in the widthwise direction under the control of the printbar-position controller 9.

A control unit 10 controls the overall operation of the printer 1 and, in particular, controls the print controller 7 and the printbar-position controller 9 during calibration-pattern printing methods to be described later. In this example the printer 1 also includes a scanning-type sensor 12 whose detecting element is a relatively low-cost densitometer. The control unit 10 is connected to the scanner 12 and receives measurement output from the scanner 12. The control unit 10 may be implemented in any convenient manner for example using one or more processors cooperating with memory (not shown).

The printer 1 includes a media transport mechanism (not shown) for transporting a substrate through the printer along a printing path. The media transport mechanism may allow a substrate to be advanced through the printer in a first direction and retreated through the printer in a direction opposite to the direction of advance.

One example of a type of small printing irregularity that may affect images printed by printing devices such as that of FIG. 1, which have the printing nozzles provided on plural print dies, will be explained with reference to FIGS. 2 to 4, to illustrate a case where a scanning device cannot properly detect the small irregularities. Additional defects will be discussed in relation to FIG. 5.

Figure 2:
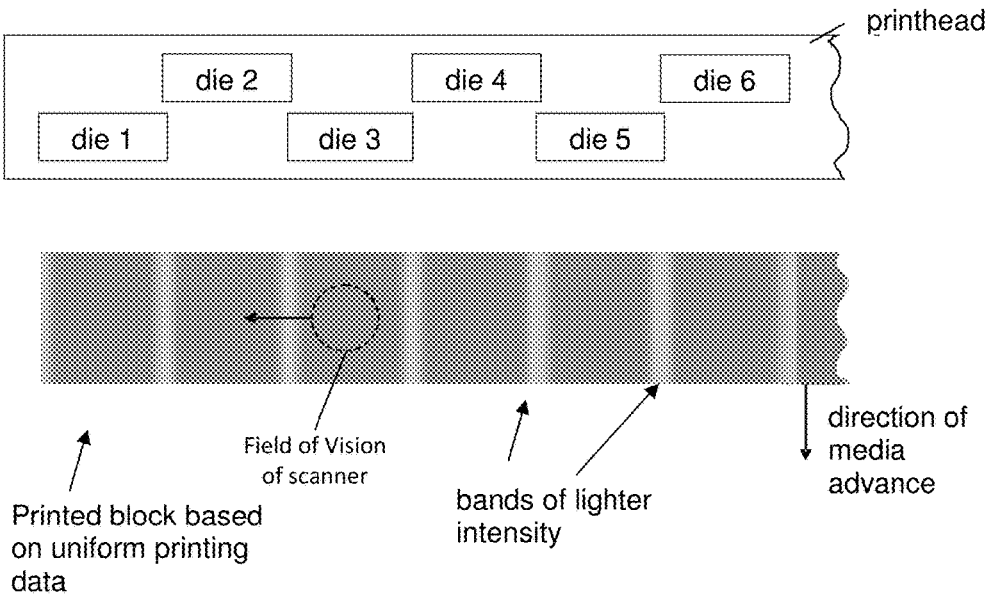
FIG. 2 illustrates an example of an image that may be printed by a printing device according to FIG. 1.

As illustrated schematically in FIG. 2 (which represents a portion of a printbar and its printed output), a printhead having plural dies and which is provided with printing data to print a uniform block of a constant hue tends to produce, on the substrate, a printed block that has some variability, instead of being entirely uniform. A reason for this is that a number of print nozzles at the end of a print die tend to print smaller ink drops than the medial print nozzles that are situated closer to the centre of the print die. It will be seen in FIG. 2 that the printed image of the uniform block of colour has lighter bands at positions that correspond to the ends of the print dies.

Figure 3:
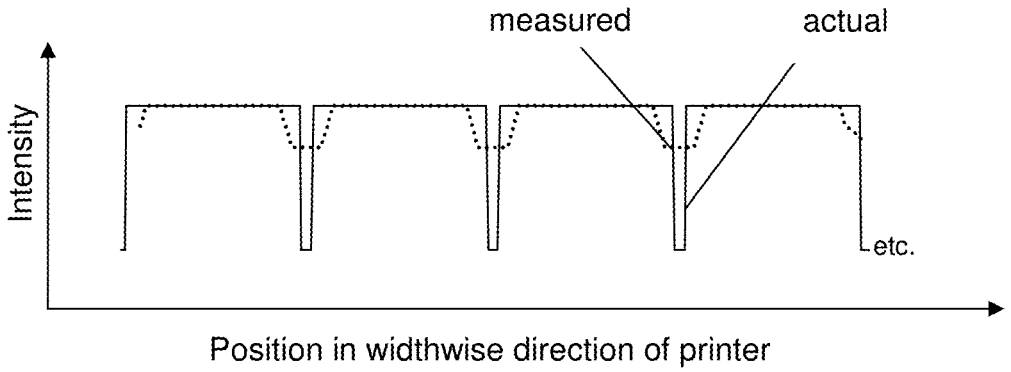
FIG. 3 illustrates a portion of the detection output that may be produced by a sensor measuring the image shown in FIG. 2.

When the printed block is scanned by the relatively low-cost scanner 12, whose field of view is illustrated in FIG. 2, the intensity measured as the scanner 12 pans across the printed image is as represented by the dotted line in FIG. 3. However, the actual variation in intensity is as illustrated by the solid lines in FIG. 3 and it is considerably greater in amount than that measured by the sensor 12. The intensity measured by the scanner 12 may be compared with a reference value (e.g. the intensity measured at print locations away from the ends of the print dies) to determine print nozzle locations where the printed output does not correspond to the desired output, and a correction factor may be determined for use during subsequent printing operations involving the print nozzle locations in question. However, if a correction or compensation operation is performed based on the output from the sensor 12 that is illustrated in FIG. 3 then the true error will not be accurately compensated and irregularities may still be visible in the images printed by the printer.

Figure 4:
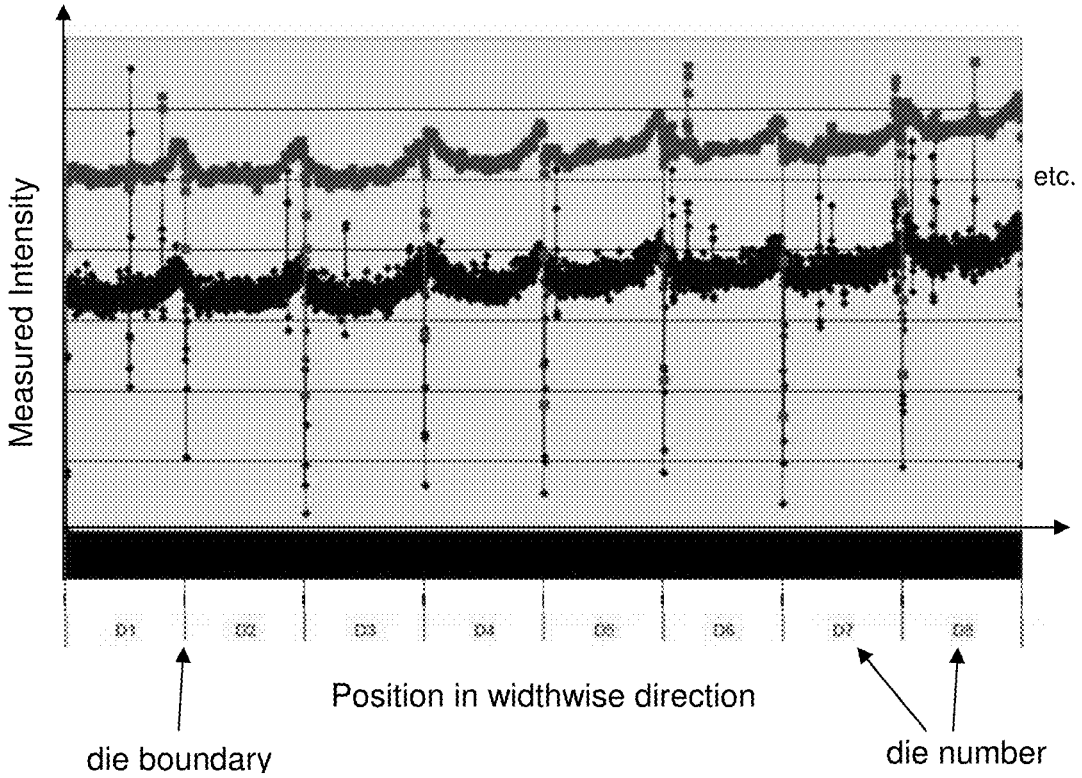
FIG. 4 illustrates detection output that may be produced by a high-performance detector measuring another example image printed by a printing device according to FIG. 1.

A high performance scanning device can measure intensity variations of this kind accurately, as illustrated by the trace portions shown in FIG. 4, which were produced by a high-performance scanner. However, the cost of the printer 1 would be increased if the scanner 12 were to be replaced by a high-performance scanning device of this type.

Figure 5:
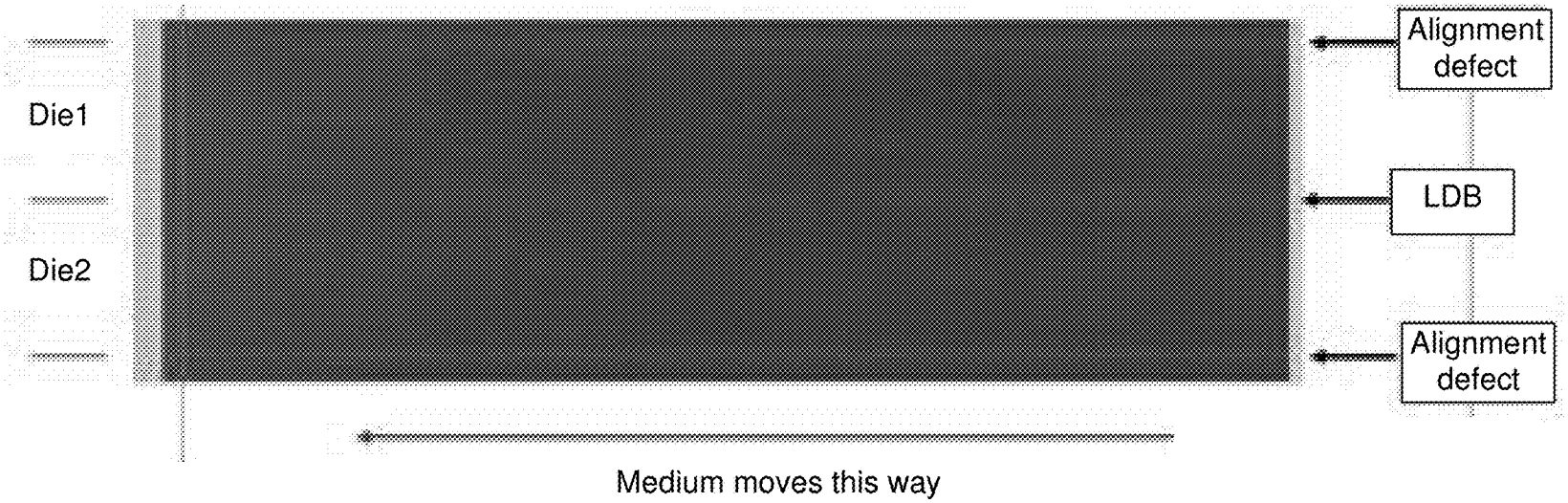
FIG. 5 illustrates an example of yet another image that may be printed by a printing device according to FIG. 1.

The above description concerns printing errors that arise due to ink drop variability at the ends of a print die, and which may be detected (to enable error-correction, or "calibration", of the printer) by printing of a calibration pattern corresponding to a block of uniform hue and measuring how the intensity of the actual image printed on a substrate varies. Various other printing errors which may occur can also be detected by printing calibration patterns and taking measurements on the printed calibration patterns. FIG. 5 illustrates a portion of an image printed by a printer having several print dies based on printing data that represents a solid block of constant hue. In this printed image certain defects are visible including alignment defects.

The appropriate calibration pattern to print when seeking to detect a printing defect may vary dependent on the nature of the defect to be detected. For example, when seeking to detect alignment defects it may be appropriate to print an interference pattern made up of a first calibration pattern portion printed by a first print die and a second calibration pattern portion printed by a different print die after the print dies have been moved. However, irrespective of the nature of the calibration pattern, if a defect in the printed calibration pattern is too small to be accurately measured by the applicable scanning component in the printer then the defect will not be accurately compensated/corrected.

Figure 6:
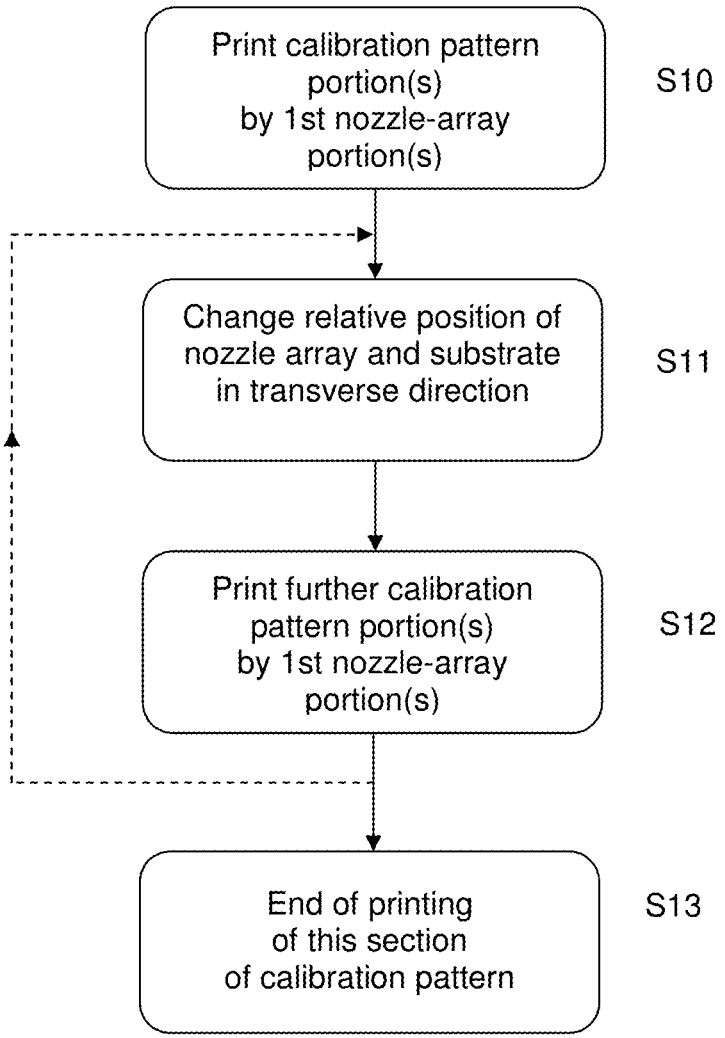
FIG. 6 is a flow diagram of a calibration-pattern printing method according to one example.
Figures 7A, 7B, 7C, 7D, 7E:
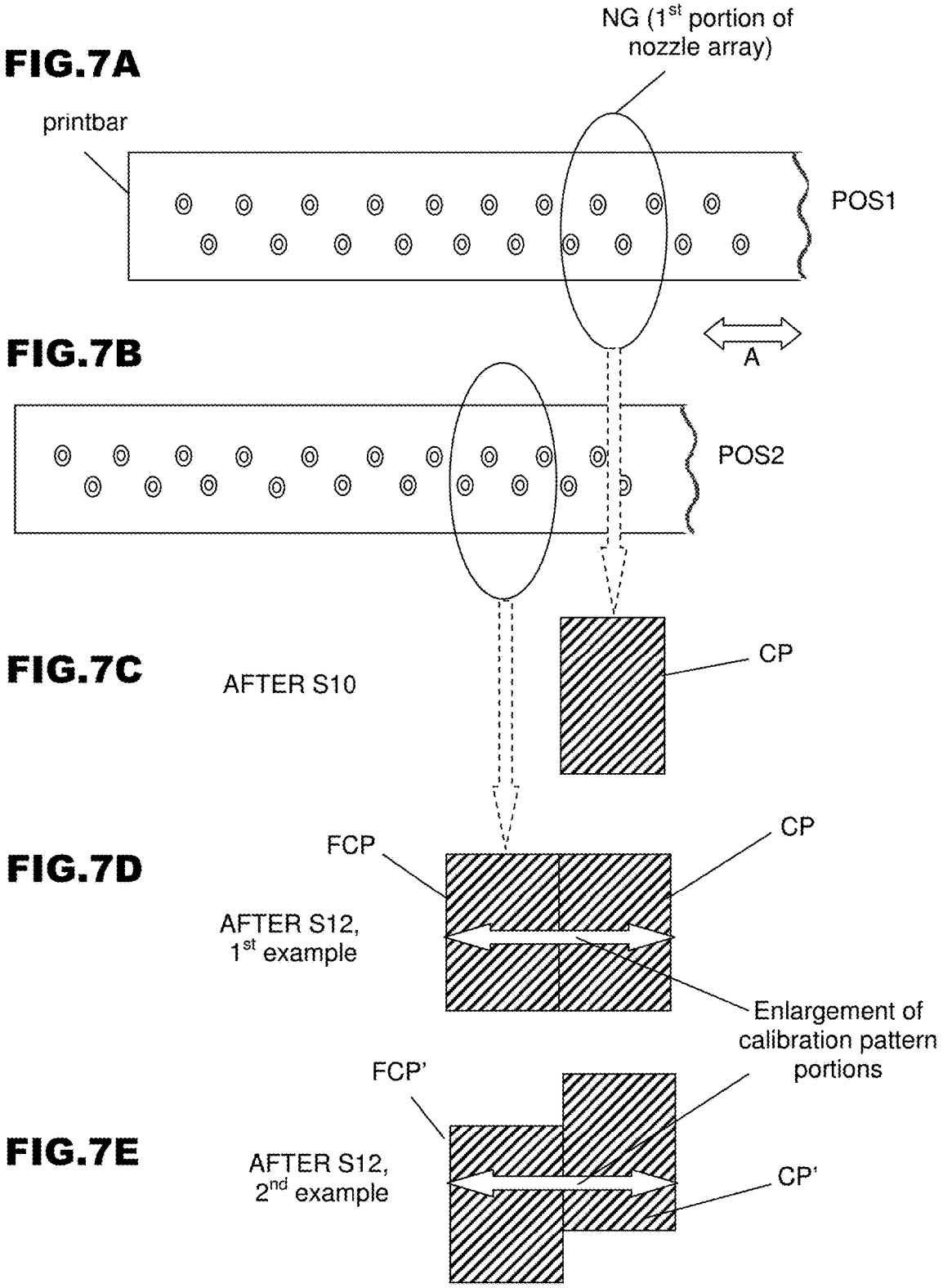
FIGS. 7A to 7E illustrate how an enlarged calibration pattern portion may be produced in one example method.

A calibration-pattern printing method according to one example of the invention will now be described with reference to FIGS. 6 and 7. FIG. 6 is a flow diagram illustrating the processes involved in the method according to this example, and FIG. 7 is a diagram illustrating how the positioning of an array of print nozzles changes in the method of this example, and the effect this produces on the printed calibration pattern. FIGS. 7A to 7E illustrate different aspects of the method.

As shown in FIG. 6, the calibration-pattern printing method of this example includes a process S10 of printing one or more calibration pattern portions by respective first portions of the nozzle array. In the example illustrated in FIG. 7 (which is highly simplified), the nozzle array shown partially in FIGS. 7A and 7B includes two rows of staggered nozzles and a group of four adjacent nozzles (circled by a ring NG in FIG. 7A) constitute a single "first portion" of the nozzle array that is controlled to print a single calibration pattern portion CP in step S10. In other cases a set of "first portions" of the nozzle array may be operated so that they all print a respective first calibration pattern during step S10. An example of that type will be discussed below with reference to FIGS. 8 to 10. The different "first portions" of the nozzle array may be driven to print respective first calibration portions that are different from each other.

FIG. 7C shows a calibration pattern portion CP in the form of a block that is printed by the first portion of the nozzle array (i.e. nozzle group NG) during the step S10 according to the example of FIG. 6. It will be noticed that the printbar is in a first position (designated POS1) in the widthwise direction of the printer during the printing operation of S10, as illustrated in FIG. 7A. In this example, the print controller 7 activates the identified four adjacent print nozzles NG so that they print a calibration pattern portion CP of desired characteristics (shape, hue, etc.) in step S10, and the printbar-position controller 9 controls the printbar to be in position POS1 during this printing operation: these operations of the print controller 7 and printbar-position controller 9 may be controlled by the control unit 10. The dotted arrow drawn from FIG. 7A to FIG. 7C illustrates that the nozzle group NG prints the calibration pattern portion CP.

As shown in FIG. 6, in step S11 of the method according to this example the relative position of the nozzle array and the substrate in the widthwise (transverse) direction of the printer is changed. In this example the change in relative position is achieved by moving the nozzle array to the position POS2 illustrated in FIG. 7B, while the widthwise position of the substrate is not changed. This lateral shift of the printbar may be achieved using the printbar-position controller 9 illustrated in FIG. 1 under the control of the control unit 10.

With the nozzle array in the changed lateral position POS2, the first portion NG of the nozzle array is activated again so as to print a further calibration pattern portion FCP in step S12 of the FIG. 6 method. The dotted arrow drawn from FIG. 7B to FIG. 7D illustrates that the nozzle group NG prints the calibration pattern portion CP.

In the example illustrated in FIG. 7 the calibration pattern portion CP and further calibration pattern portion FCP printed by the same first portion of the nozzle array have the same shape and size, but the invention is not limited to that case: in some cases the calibration pattern portion CP and further calibration pattern portion FCP printed by the same first portion of the nozzle array may be different from one another.

It will be understood from FIG. 7D that in implementing the method of FIG. 6 the calibration pattern portion CP and further calibration pattern portion FCP are printed by the same group of nozzles NG in a manner whereby they are contiguous in the widthwise direction of the printer, that is, the edges of the two pattern portions touch, with negligible overlap and negligible empty space between them so that they form, in effect, a widthwise-enlarged calibration pattern portion. The widthwise-enlarged calibration pattern portion formed of CP+FCP printed on the substrate can be scanned and its properties analysed and this will provide information about the print characteristics of the nozzle group NG which, normally, prints over a substrate region of considerably smaller width. This enlargement of the printing pattern produced by a given portion of the nozzles may enable printing defects caused by that nozzle portion to be detected more accurately by a scanner or other detection device.

A contiguous disposition of the calibration pattern portion CP and further calibration pattern portion FCP printed by the same nozzle group NG in steps S10 and S12 is obtained by setting the distance between POS1 and POS2 in the widthwise direction of the printer to match the width of the calibration pattern portion printed by the nozzle group in question. The accuracy of the matching depends on the accuracy of the relative positioning of the nozzle array and the substrate in the widthwise direction of the printer. Some calibration-pattern printing methods according to examples of the invention include, as a preliminary step, a process of calibrating the position of the printbar in the widthwise direction.

Depending on the resolution of the scanner 12 in the printing device 1, it may be necessary to enlarge the calibration pattern portion printed by a given nozzle group to a greater degree than is achievable by simply printing two calibration pattern portions as illustrated in FIG. 7. In such a case steps S11 and S12 of the method of FIG. 6 may be repeated (as illustrated by the dotted arrow) as many times as is necessary to produce an enlarged calibration pattern portion of a width sufficient to allow the print characteristics of this portion to be accurately determined by the scanner. Successively-printed calibration pattern portions and further calibration pattern portions join up in the widthwise direction to form the overall enlarged calibration pattern portion.

In the example illustrated in FIG. 7D the adjacent calibration pattern portions printed by the same "first group" of nozzles are aligned in the longitudinal direction of the printer; in other words, the top and bottom edges of CP and FCP are aligned. A simple manner for achieving this longitudinal alignment is to move the substrate back through the printer between steps S10 and S12 of FIG. 6, reversing the direction of travel of the substrate, so that the substrate is in the same position in the longitudinal direction of the printer at the start of each of the printing operations in steps S10 and S12. An equivalent approach for returning the substrate to the start position is to move the nozzle array relative to the substrate in the longitudinal direction in between steps S10 and S12.

Another alternative for achieving longitudinal alignment consists in using two-directional printing, that is, moving the substrate through the printer in the longitudinal direction in a first sense (e.g. to print the block CP starting from the top thereof as illustrated in FIG. 7) during printing of the calibration pattern portion CP in step S10 and then moving the substrate through the printer in the longitudinal direction in the opposite sense (e.g. to print the block FCP starting from the bottom thereof as illustrated in FIG. 7) during printing of the calibration pattern portion FCP in step S12.

FIG. 7D illustrates the case where the relative position of the nozzle array and substrate is controlled during printing of the calibration pattern portions so that there is full longitudinal alignment of the calibration pattern portion CP and the further calibration pattern portion FCP. However, the invention is not limited to that case. In a second example, the longitudinal positions of the nozzle array and substrate may be controlled during the printing operations of S10 and S12 so that there is only partial alignment of the printed calibration pattern portion CP' and the further calibration pattern portion FCP' in the longitudinal direction as illustrated in FIG. 7E. Even in this partially-aligned arrangement the contiguous calibration pattern portions CP' and FCP' form a region of enlarged width which can be used to derive printing characteristic data regarding a nozzle portion that normally prints over a relatively smaller width.

In practice, there is a minimum feature size that can be detected properly by scanner devices not only in the widthwise direction of the printed page but also in the longitudinal direction. When the extent of the enlarged calibration pattern portion in the longitudinal direction matches or exceeds this minimum feature size then the enlarged calibration pattern portion can be properly detected by the scanner. An enlarged calibration pattern portion extending approximately 0.3 inches or more in the longitudinal direction is an example of a portion which can be detected by certain scanner devices.

A calibration-pattern printing method according to another example of the invention will now be described with reference to FIGS. 8 to 10.

Figure 8:
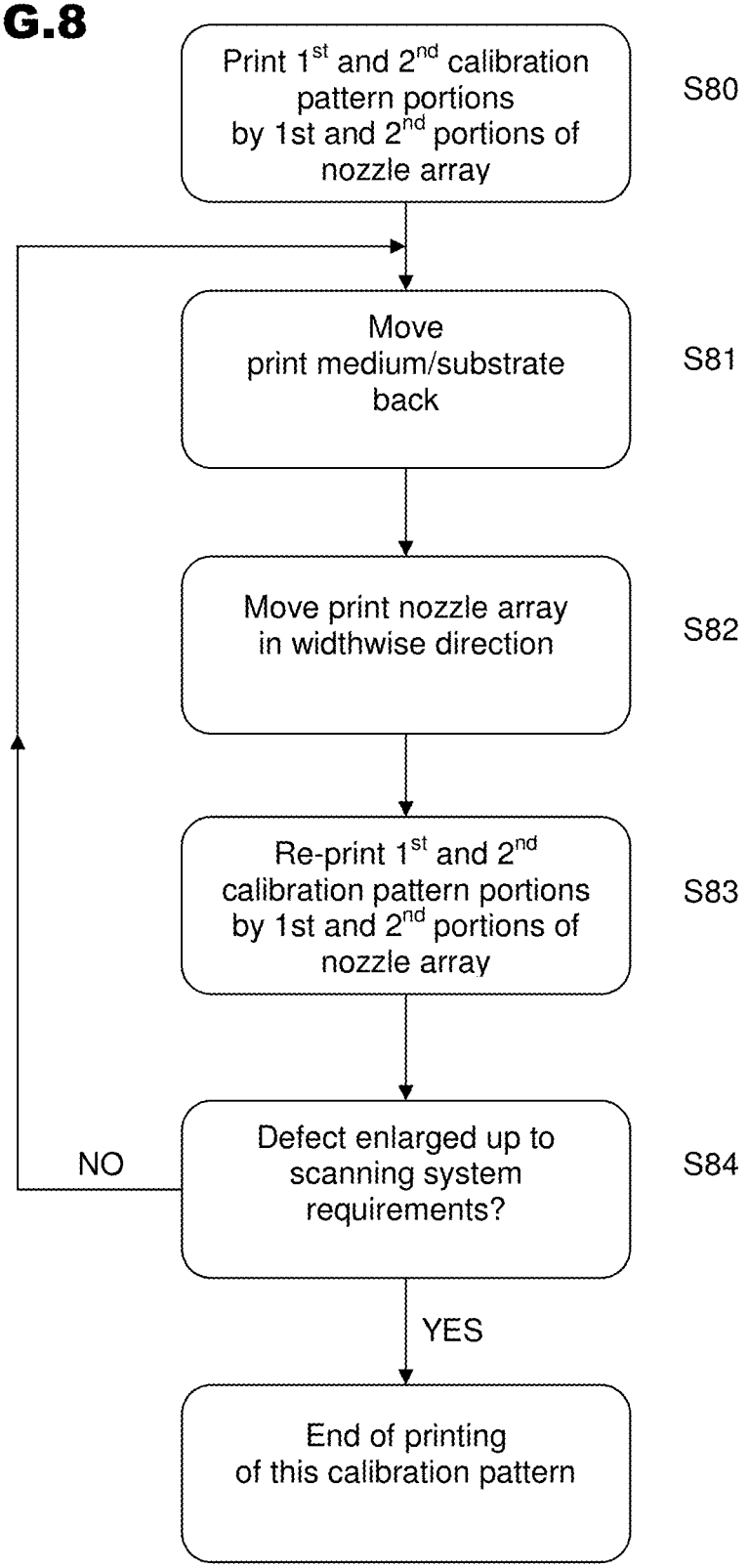
FIG. 8 is a flow diagram of a calibration-pattern printing method according to one example.

FIG. 8 is a flow diagram illustrating the processes involved in the method according to this example, and FIG. 9 is a series of diagrams illustrating how a printed calibration pattern may build up during implementation of the method.

Figure 9A:
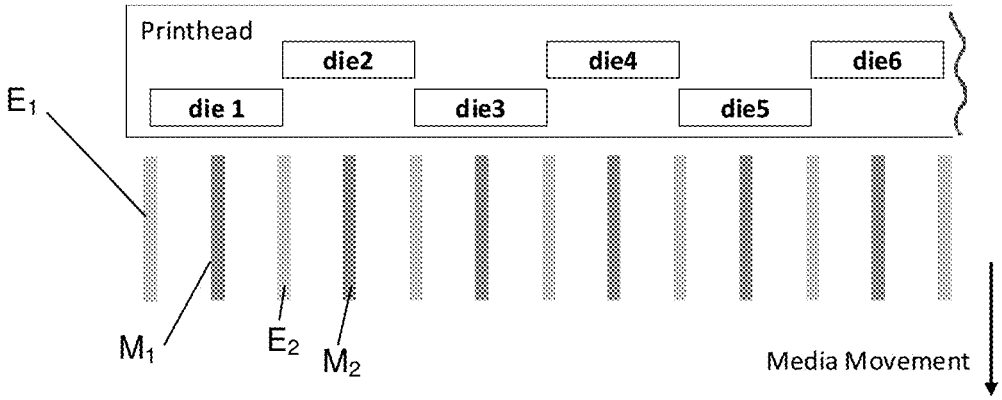
FIGS. 9A-9D schematically show how a printing device according to FIG. 1 and having six print dies may build up a calibration pattern according to the method of FIG. 8.

As shown in FIG. 8, the calibration-pattern printing method of this example includes a process S80 of printing first and second calibration pattern portions by first and second portions of the nozzle array. In the example illustrated in FIG. 9, the nozzle array includes print nozzles on print dies that are arranged in two staggered rows, groups of nozzles at the ends of the dies constitute a set of "first portions" of the nozzle array and groups of nozzles towards the centre of the print dies constitute a set of "second portions" of the nozzle array. The first nozzle-array portions are controlled to print calibration pattern portions E1, E2, etc. during step S80 of FIG. 8, whereas the second nozzle-array portions are controlled to print calibration pattern portions M1, M2, etc. during step S80, producing a combined calibration pattern portion as illustrated in FIG. 9A. (FIG. 9A illustrates the printing operation of Step S80).

In this example the calibration pattern portions printed by the first nozzle-array portion form a set of stripes separated by spaces, and the calibration pattern portions printed by the second nozzle-array portion form another set of stripes separated by spaces, and the two sets of stripes are interleaved. The invention is not limited to this case and calibration pattern portions of other configurations may be used. In the example of FIG. 9, because gaps are provided between the first calibration pattern portions printed so by the nozzles of the first nozzle-array portion and gaps between the second calibration pattern portions printed by the nozzles of the nozzle-array portion there is space for enlargement of the calibration pattern portions without overlapping with other, prior-printed calibration pattern portions.

Figure 9B:
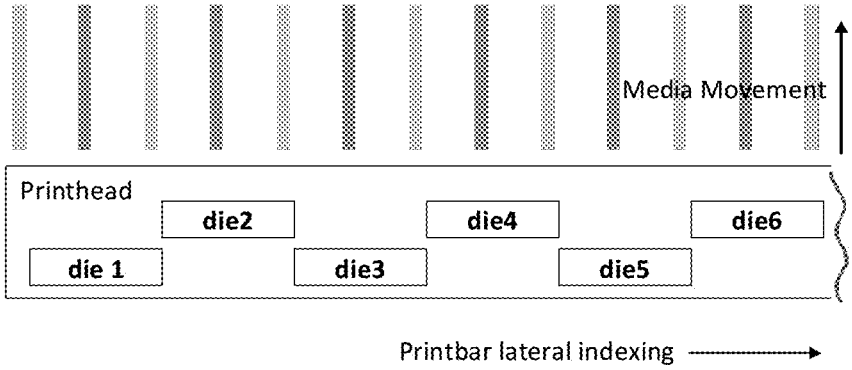

In step S81 of FIG. 8, the print medium is moved back through the printer after the printing operation of S80, to position the print medium in the same position as it was (in the longitudinal direction) at the start of the printing operation of S80. In step S82 of the FIG. 8 method the print nozzle array is moved in the widthwise direction analogously to the change from POS1 to POS2 in FIG. 7. The arrows in FIG. 9B illustrate these two movements of S81 and S82.

Figure 9C:
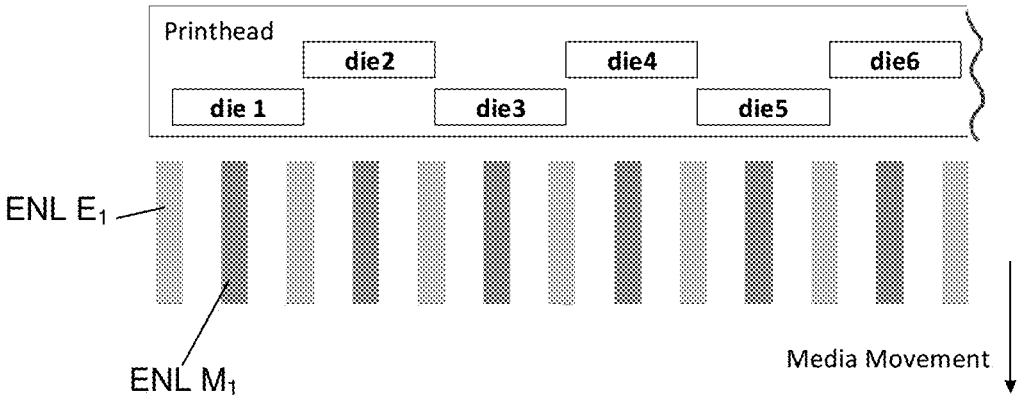

In step S83 of FIG. 8 the first nozzle-array portions are controlled to re-print calibration pattern portions E1, E2, etc. and the second nozzle-array portions are controlled to re-print calibration pattern portions M1, M2, etc. but, in view of the lateral shift that has taken place in the printbar in step S82, the reprinted calibration pattern portions printed by a given nozzle portion are contiguous with the previous calibration pattern portions printed by this same nozzle portion. FIG. 9C illustrates the printing operation of S83 of FIG. 8. The leftmost first nozzle-array portion illustrated in FIG. 9C produces an enlarged calibration pattern portions ENL E1, the leftmost second nozzle-array portion illustrated in FIG. 9C produces an enlarged calibration pattern portions ENL M1, and so on. These enlarged calibration pattern portions ENL E and ENL M may be sufficiently wide to permit accurate measurements of print characteristics to be taken by a scanner device. However, if the enlargement is not sufficient to bring print defects up to a size meeting the requirements of the scanning system then steps S81 to S83 may be repeated as many times as necessary, as indicated by the loop from S84 to just before S81 in FIG. 8.

Figure 9D:
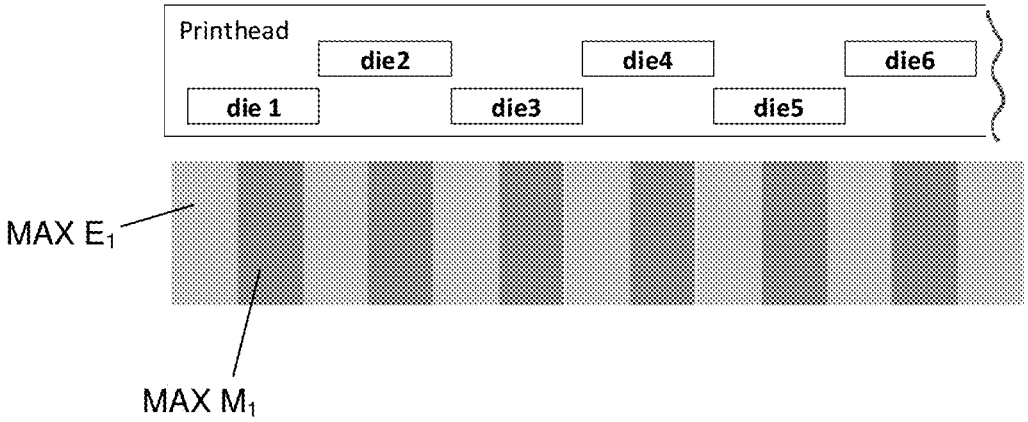

FIG. 9D illustrates a case where steps S81 to S84 of FIG. 8 have been repeated a maximum number of times and no space remains for printing further calibration pattern portions to the side of the portions that have already been printed.

As indicated above, in the example illustrated in FIG. 9 the first nozzle-array portions correspond to nozzles at the ends of print dies and it is expected that these nozzles will produce fainter print output than nozzles that are closer to the centre of the print dies. Accordingly, the enlarged calibration pattern portions M printed by the second nozzle-array portions (i.e. printed by nozzles that are not at the ends of print dies) serve as a reference that can enable a detector device to evaluate the degree of this lightening effect.

Figure 10:
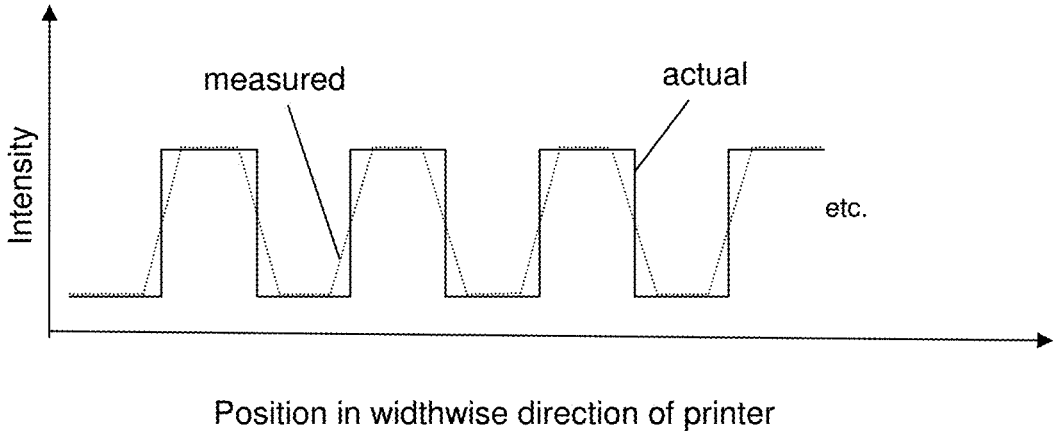
FIG. 10 illustrates a portion of the detection output that may be produced by a sensor measuring the printed image illustrated in FIG. 9D.

FIG. 10 illustrates an example of a portion of the output produced by a scanning device performing measurements on the overall calibration pattern represented in FIG. 9D. The scanning device has comparable sensitivity to the scanning device whose output is illustrated in FIG. 3.

It will be seen from a comparison of FIG. 10 with FIG. 3 that the scanning device detects the extent and pattern of variation in printed image intensity across the page considerably more accurately in the case of FIG. 10 than in the case of FIG. 3. In other words, the enlargement of the calibration pattern portions printed by groups of nozzles in methods according to examples of the invention enables the same scanning device to achieve improved accuracy in detecting print defects associated with those nozzles.

The number of nozzles at the ends of a print die which are susceptible to print at a lighter intensity than the nozzles towards the centre of the print die is not always the same. The affected number of nozzles at the ends of the print dies can be determined as part of a product-characterization process during the manufacture of the nozzle array, the printing assembly or the overall printer itself, and this number may be stored in memory for use during the calibration-pattern printing process. Alternatively this number may be used to generate driving data for the calibration-pattern printing process and the driving data may be stored. The calibration-pattern printing process of FIGS. 8 and 9 can then be implemented to include the predetermined number of nozzles in the first nozzle-array portions.

Figure 11:
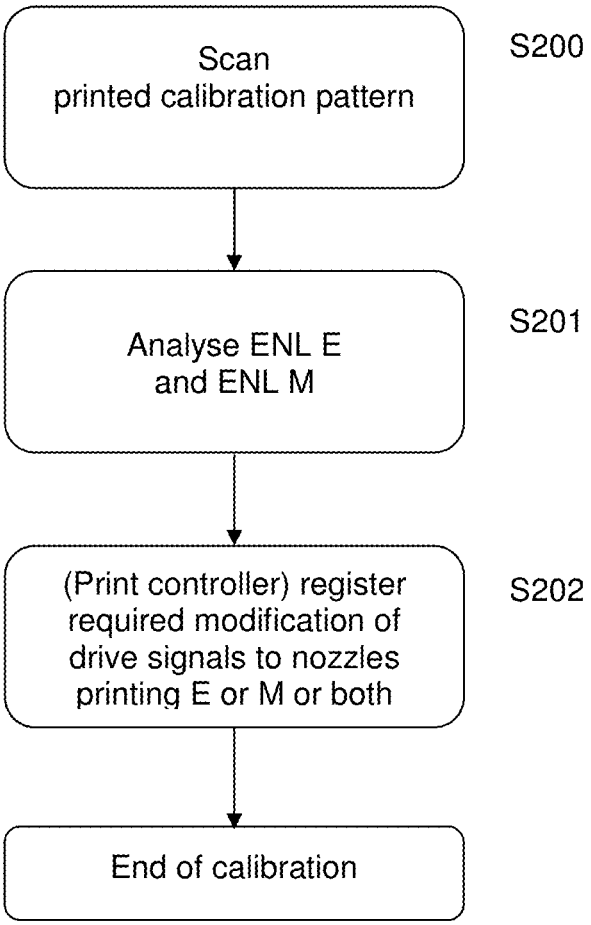
FIG. 11 is a flow diagram of a calibration method according to an example.

As mentioned above, the output of scanning devices which scan a calibration pattern may be used to calibrate components in the printer. FIG. 11 illustrates a calibration method according to an example of the invention. In step S200 of the calibration method according to the example of FIG. 11, a printed calibration pattern including at least one enlarged calibration pattern portion produced, in this example, by the calibration-pattern printing method according to FIGS. 8 and 9, is scanned by a scanning device provided in the printer, such as element 12 of FIG. 1.

The scanning device includes a sensor element (e.g. a densitometer) that detects the density of ink in the printed image as the sensing element is moved across the calibration pattern in the widthwise direction. In this example the output from the scanning device is supplied to a processing element, such as control unit 10 in FIG. 1, which is configured to analyze the calibration pattern based on the output from the scanning device (step S201 of FIG. 11). In this example, the control unit 10 is programmed to measure the difference between the measured density at regions corresponding to enlarged calibration pattern portions E printed by the first nozzle-array portions and at regions corresponding to the enlarged reference calibration pattern portions M printed by the second nozzle-array portions. This difference represents the degree by which the nozzles at the ends of the print dies are printing lighter than the nozzles towards the centres of the print dies. The drive signals for activating the print nozzles at the ends of the print dies can be modified based on the measured difference, notably to drive those nozzles with a greater-than-standard signal in order to compensate for the fact that these nozzles print lighter-than-expected.

Based on its analysis of the output from the scanning device in S201 of FIG. 11, the control unit can inform the print controller of the manner in which the drive signals to the print nozzles of the first nozzle-array portion should be adjusted for future printing operations. The print controller notes this information, for example by writing into a memory some data defining a function to be used when converting print data to drive signals for the nozzles in question during subsequent printing operations. However, the invention is not limited to that approach.

In the calibration method illustrated in FIG. 11, the control unit 10 makes use of measurement data relating to an enlarged calibration pattern portion (e.g. ENL E1 in FIG. 9C) to determine how the drive signals to a relatively narrower nozzle-array portion should be modified. In other words, when deciding how to modify the drive signal for a nozzle-array portion NG which is designed to print across a region of width w on a substrate, the control unit makes use of scanner output relating to a region of width w in a calibration pattern, this region w having a greater width than w and corresponding to an enlarged calibration pattern portion printed by repeated operation of the nozzle-array portion NG. In order to determine correctly which print nozzles require corrective action the control unit 10 is programmed to know the correspondence between each of the regions spanned by the enlarged calibration pattern portions in the printed image and the print nozzles that printed those enlarged calibration pattern portions.

Calibration processes according to examples of the invention may be implemented from time to time during the lifetime of a printer, to keep the calibration of the printer accurate despite varying conditions, for example as environmental conditions change, as the printer components age, when components in the printer are replaced, as operating conditions (print speed, print medium, etc.) change, and so on. By basing the calibration on a freshly printed and analyzed calibration pattern, instead of on a pre-stored calculation based on characterization of the printer at the time of manufacture, the calibration may compensate for dynamic factors and, thus, produce a more accurate compensation of errors.

Although certain examples of methods and printers have been described, it is to be understood that changes and additions may be made to the described examples within the scope of the appended claims.

For instance, in the examples described above the relative position between a print medium and a print nozzle array in the longitudinal direction is varied by moving the substrate back and forth as required along a printing path. However, it is to be understood that the relative motion could be obtained by holding the substrate still and moving the array of print nozzles back and forth in the longitudinal direction, or by a combination of movement of the substrate and the nozzle array.

As another instance, the examples described above refer to monochrome printing using print nozzles on a single printbar. However, the invention is applicable in general to the printing of calibration patterns in monochrome and color printers.

As yet another instance, the above description refers to the use of scanning devices for measuring the print characteristics of images, notably of calibration patterns. However, the invention is not limited to the use of measurement devices which scan across a printed image, other kinds of detection and/or measurement devices may be used.

As still another instance, the above description refers to printers in which the printing elements include a printbar and print dies bearing print nozzles. However the invention is not particularly limited having regard to the configuration of the array of print nozzles in the printing element.

The invention claimed is:

1. A method comprising:

determining, by a printer, a difference between an enlarged calibration pattern portion printed on a substrate by end portions of print dies in a nozzle array of the printer and an enlarged reference pattern portion printed on the substrate by center portions of the print dies in the nozzle array, the enlarged calibration pattern portion produced by printing respective smaller calibration pattern portions by the end portions of the print dies at corresponding different relative positions between the nozzle array and the substrate caused by relative movement between the nozzle array and the substrate, and the enlarged reference pattern portion produced by printing respective smaller reference pattern portions by the center portions of the print dies at corresponding different relative positions between the nozzle array and the substrate caused by relative movement between the nozzle array and the substrate; and adjusting, by the printer, at least one drive signal to at least one of the end portions of the print dies and the center portions of the print dies to compensate for the determined difference.

2. The method of claim 1, wherein the smaller calibration pattern portions are at least partially aligned with each other in a longitudinal direction of the printer and join up in a widthwise direction of the printer to form the enlarged calibration pattern portion, and wherein the corresponding different relative positions between the nozzle array and the substrate for printing the respective smaller calibration pattern portions are based on changing relative positions between the nozzle array and the substrate in the widthwise direction.

3. The method of claim 2, wherein a relative position of the nozzle array and the substrate in the widthwise direction is changed by moving the nozzle array in the widthwise direction.

4. The method of claim 1, wherein the determined difference comprises a difference between a density of the enlarged calibration pattern portion and a density of the enlarged reference pattern portion.

5. The method of claim 4, wherein the difference between the density of the enlarged calibration pattern portion and the density of the enlarged reference pattern portion represents a degree by which the end portions of the print dies are printing more lightly than the center portions of the print dies.

6. The method of claim 5, wherein adjusting the at least one drive signal comprises increasing the at least one signal to compensate for the end portions of the print dies printing more lightly.

7. The method of claim 1, wherein the adjusting is performed by a print controller of the printer, and wherein the determining is performed by a control unit comprising a processor, the method further comprising:

providing, by the control unit to the print controller, information that is based on the determining, wherein the adjusting is performed by the print controller based on the information.

8. The method of claim 7, wherein the information comprises a function that converts between print data to be printed and drive signals produced by the print controller.

9. The method of claim 2, wherein the adjusting comprises adjusting drive signals of nozzles of the nozzle array spanning a distance in the widthwise direction that is less than a widthwise extent of the enlarged calibration pattern portion.

10. The method of claim 1, comprising:

in a first pattern printing operation when the nozzle array and the substrate are at a first relative position, printing a first smaller calibration pattern portion by the end portions of the print dies, and printing a first smaller reference pattern portion by the center portions of the print dies;

in a second pattern printing operation after relative movement between the nozzle array and the substrate to a second relative position different from the first relative position, printing a second smaller calibration pattern portion by the end portions of the print dies, and printing a second smaller reference pattern portion by the center portions of the print dies, wherein the first and second smaller calibration pattern portions are part of the enlarged calibration pattern portion, and the first and second smaller reference pattern portions are part of the enlarged reference pattern portion.

11. A non-transitory storage medium storing instructions that upon execution cause a system to:

determine a difference between a characteristic of an enlarged first pattern portion printed on a substrate by end portions of print dies in a nozzle array in a printer and a characteristic of an enlarged second pattern portion printed on the substrate by center portions of the print dies in the nozzle array, the enlarged first pattern portion produced by printing respective smaller first pattern portions by the end portions of the print dies at corresponding different relative positions between the nozzle array and the substrate caused by relative movement between the nozzle array and the substrate, and the enlarged second pattern portion produced by printing respective smaller second pattern portions by the center portions of the print dies at corresponding different relative positions between the nozzle array and the substrate caused by relative movement between the nozzle array and the substrate; and cause adjustment of at least one drive signal to at least one of the end portions of the print dies and the center portions of the print dies based on the determined difference.

12. The non-transitory storage medium of claim 11, wherein determining the difference is based on measurements of the characteristics of the enlarged first pattern portion and the enlarged second pattern portion by a sensor.

13. The non-transitory storage medium of claim 11, wherein determining the difference is based on measurements of the characteristics of the enlarged first pattern portion and the enlarged second pattern portion by a densitometer.

14. The non-transitory storage medium of claim 11, wherein the difference between the characteristics of the enlarged first pattern portion and the enlarged second pattern portion represents a degree by which the end portions of the print dies are printing more lightly than the center portions of the print dies.

15. The non-transitory storage medium of claim 14, wherein causing the adjustment comprises causing an increase in the at least one drive signal to compensate for the end portions of the print dies printing more lightly than the center portions of the print dies.

16. The non-transitory storage medium of claim 11, wherein the instructions upon execution cause the system to:

generate, based on the determined difference, information that converts print data to be printed to drive signals for the nozzle array.

17. The non-transitory storage medium of claim 11, wherein causing the adjustment comprises causing adjustment of drive signals of nozzles of the nozzle array spanning a distance in a widthwise direction that is less than a widthwise extent of the enlarged first pattern portion.

18. A printer comprising:

a nozzle array extending in a widthwise direction;

a print controller to control activation of print nozzles of the nozzle array, the print controller to:

in a first pattern printing operation when the nozzle array and a substrate are at a first relative position, control printing of a first calibration pattern portion by a first portion of the nozzle array, and printing of a first reference pattern portion by a different second portion of the nozzle array, wherein the nozzle array comprises a set of print dies, the first portion of the nozzle array comprising nozzles at end portions of each print die of the set of print dies, and the second portion of the nozzle array comprising nozzles at a center portion of each print die of the set of print dies;

in a second pattern printing operation after relative movement between the nozzle array and the substrate to a second relative position different from the first relative position, control printing of a second calibration pattern portion by the first portion of the nozzle array, and printing of a second reference pattern portion by the second portion of the nozzle array, the first and second calibration pattern portions collectively forming an enlarged calibration pattern portion on the substrate, and the first and second reference pattern portions collectively forming an enlarged reference pattern portion on the substrate; and at least one processor to:

determine a difference between the enlarged calibration pattern portion and the enlarged reference pattern portion; and cause adjustment of at least one drive signal from the print controller to at least one of the first portion of the nozzle array and the second portion of the nozzle array based on the determined difference.

19. The printer of claim 18, wherein the first and second calibration pattern portions are at least partially aligned with each other in a longitudinal direction of the printer and join up in the widthwise direction to form the enlarged calibration pattern portion, and wherein the relative movement between the nozzle array and the substrate is in the widthwise direction.

* * * * *